United States Patent [19]

Carlson

[11] Patent Number: 4,602,782

[45] Date of Patent: Jul. 29, 1986

[54] DEVICE FOR DOING SITUPS

[76] Inventor: Dennis G. Carlson, Rte. #3, Carbondale, Ill. 62901

[21] Appl. No.: 677,742

[22] Filed: Dec. 3, 1984

[51] Int. Cl.[4] ..... A63B 23/00

[52] U.S. Cl. ..... 272/93; 272/900

[58] Field of Search ..... 272/93, 145, 143, 900

[56] References Cited

U.S. PATENT DOCUMENTS

| | | | |
|---|---|---|---|
| D. 203,836 | 2/1966 | Hass | 272/900 X |
| 2,658,754 | 11/1953 | Courtney | 272/145 |
| 2,831,687 | 4/1958 | Hunter | 272/145 |
| 3,250,015 | 6/1966 | Perrin | 272/137 |
| 4,060,240 | 11/1977 | Dunston | 272/900 X |
| 4,121,825 | 10/1978 | Hult | 272/93 |
| 4,225,130 | 9/1980 | Zimmerman | 272/900 X |
| 4,337,938 | 7/1982 | Rodriguez | 272/143 X |
| 4,417,726 | 11/1983 | Schleis | 272/900 X |
| 4,477,073 | 10/1984 | Koch et al. | 272/900 X |
| 4,515,361 | 5/1985 | Mellilo et al. | 272/900 X |

OTHER PUBLICATIONS

Gehri, Ser. No. 529,810 filed Sep. 1956.

*Primary Examiner*—Robert A. Hafer

*Assistant Examiner*—Kathleen D'Arrigo

*Attorney, Agent, or Firm*—Charles F. Lind

[57] ABSTRACT

An exercise device is disclosed that operates with a swinging door to assist one in doing situps and related exercises. The device has a pair of wedge stops and strap means are secured to the stops and extended therebetween. Adjustment connection means are formed in the strap means to allow the separation of the strap means into two separate pieces each secured to one of the stops, and further to allow for adjustment of the overall length of the strap means. The strap means is formed of an inelastic but flexible material possibly 20 to 40 inches long and 1 to 3 inches wide. Each stop has a base surface and a wedge surface angled from one another between 25 and 50 degrees, being between 1.5 and 2.5 inches high at the end surface. The stops fit on one side of the door, with the base surface on the floor and the wedge surface against the bottom of the door and with the strap means passing under the door. The strap means are then looped over the foot or ankle area of the exerciser, who is located on the opposite side of the door from the stops, for holding the exerciser's feet snugged against the floor and the door.

8 Claims, 5 Drawing Figures

DEVICE FOR DOING SITUPS

BACKGROUND OF THE INVENTION

Physical fitness is a growing popular trend for the general public. Doing "situps" is one of the best forms of physical fitness, involving the seldom used muscles in the stomach and abdominal areas of the body. Situps are conventionally performed lying on your back on a relatively flat surface, generally horizontal, where the buttocks of the body remains against the surface and the head and upper torso part of the body are lifted from being against the surface to being at a sharp angle relative to the surface and the lower part of the body. Although situps can be performed without having the feet held firmly against the surface, if the feet are restrained, the situps can be performed at a more rapid pace to consume less time and further can also be performed with weights held by the exerciser in the vicinity of the head to require greater effort to overcome the greater resistance against the upward movement of the torso. Repetitions are needed to achieve the utmost benefit; and regularity of exercise is needed to keep the muscles toned.

One standard device for maintaining the exerciser's feet snugged against the floor is in the form of a rigid generally padded bar horizontally spaced above the surface that allows the feet and/or ankles of the user to be put under the bar.

Several devices of this type have been proposed for use with a housing door for holding the exerciser's feet down, but they nonetheless have several significant drawbacks. For example, the devices have rigid brackets or the like which are designed to be secured relative to the underside of the door, and the bar then is supported from the brackets spaced slightly from the door and above the supporting surface with sufficient clearance to allow the exerciser to position the feet and/or the ankles under the bar. However, because of the rigidness of the securement means, there is a great likelihood of damaging the door in securing the device onto the door or in removing the device from the door or during the exercising itself due to the strain imposed on the door. Another major drawback of this type of device is that it is big and heavy, lacking portability for being packed in a person's luggage, should a person desire to use the device on a trip.

Several other exercise devices have been proposed which are designed to be located and secured under the door, the devices being formed basically of a flexible but nonelastic strap configuration. However, major drawbacks exist with each such known device and include the difficulty of securing it relative to the door or removing it from the door and the resultant possible damage the device can cause to the door, and/or the lack of easy adjustment with respect to the size of the exerciser or the type of exercise to be performed, or to the manner of securing the device or releasing it from the exerciser.

SUMMARY OF THE INVENTION

This invention relates to a device for doing "situps" and related exercises, and specifically to a device that will hold the person's feet firmly against or relative to the underlying supporting surface.

A basic object of this invention is to provide a portable, compact lightweight device that can be used in combination with a conventional door structure of a house or the like to hold a person's feet firmly against or relative to the underlying supporting surface to thereby facilitate the doing of situps and other related exercises.

A specific object of this invention is to provide a situp-assisting exercise device that is economical to fabricate, and that can be easily applied to and removed from the foot or ankle area of the user, either of a right-hand or left-hand preference.

Another specific object of this invention is to provide a portable situp-assisting exercise device that can be readily locked in place relative to the door or removed from the door with little chance of damaging the door, and further that can be used with different doors representing possibly a wide range of clearance spaces between the bottom of each door and the adjacent underlying floor. This thereby gives the user the same conditions for exercising whether in a motel or like temporary quarters or in a permanent residence or working quarters.

BRIEF DESCRIPTION OF THE DRAWINGS

The invention will be more fully understood in reference to the accompanying drawing, providing that.

DETAILED DESCRIPTION OF THE INVENTION

Figure 1:
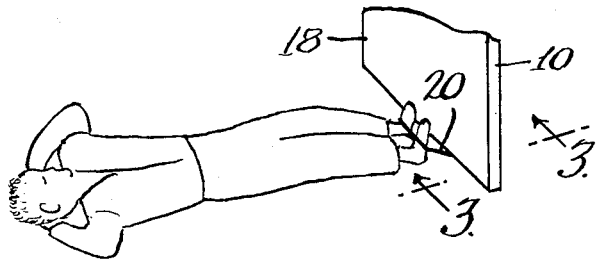
FIG. 1 is a perspective view illustrating the subject invention in operative association with a conventional door for assisting an exerciser in doing situps and related exercises by holding the exerciser's feet firmly against or relative to the underlying supporting surface.
Figure 3:
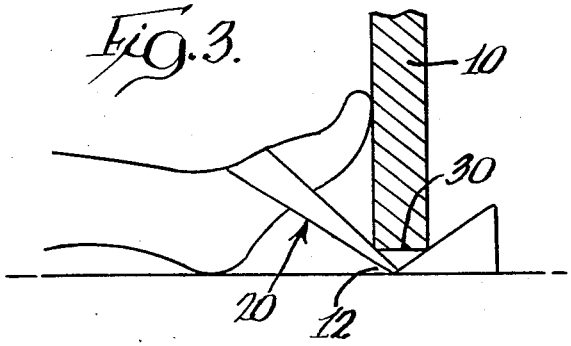
FIG. 3 is a sectional view as seen generally from line 3—3 in FIG. 1, showing the device used to hold the exerciser's foot firmly against or relative to the supporting surface and the anchoring door.
Figure 4:
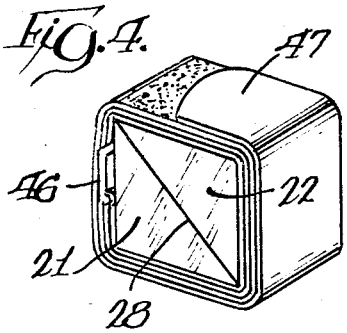
FIG. 4 is a perspective view of the device illustrated in a folded arrangement suitable for traveling.
Figure 5:
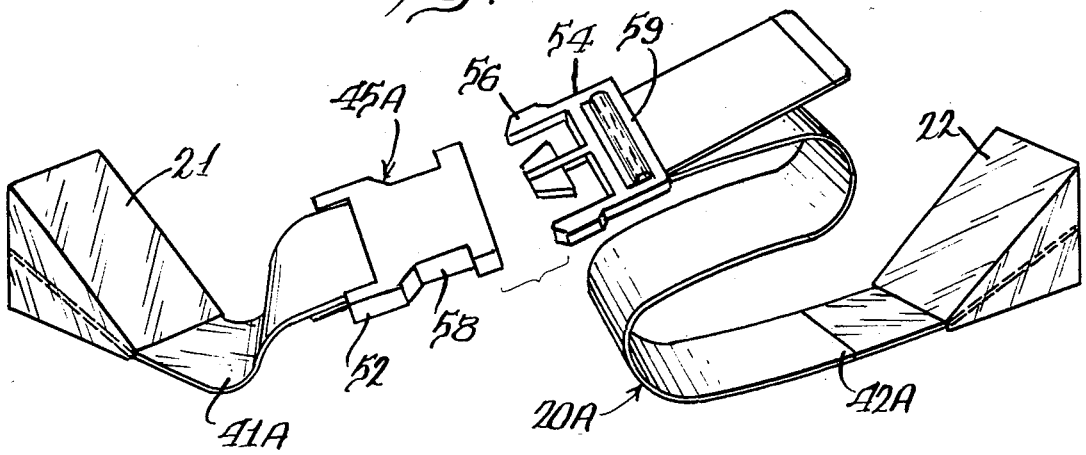
FIG. 5 is a perspective view of an alternate embodiment of the disclosed exercise device.

In FIGS. 1 and 3, a door 10 is illustrated having a certain nominal clearance 12 above the flat supporting surface or floor 14. The clearance is not of critical importance to this invention, but for reference purposes will typically be between ¼ of an inch on the low side and perhaps one inch on the high side. Also the floor may have a hard surface or it may have a covering on it offering some resilience. The conventional door 10, however, is mounted along the side edge 18 on hinges (not shown) to allow the door to swing about a vertical axis through the hinges. The exercise device 20 herein disclosed is adapted to be used with the door 10 to present a loop section that can overlie an exerciser's feet or ankles so as to hold the feet firmly against or relative to the underlying supporting floor 14.

Figure 2:
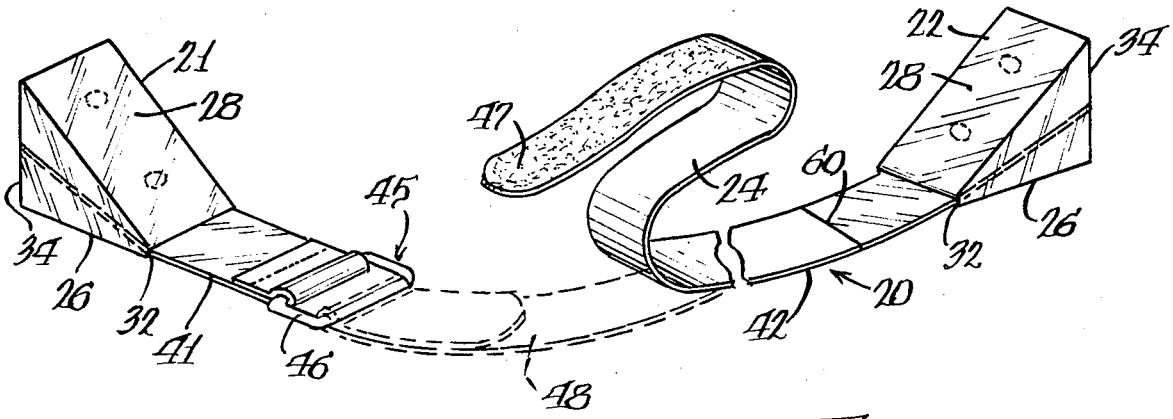
FIG. 2 is a perspective view of the device illustrated in FIG. 1, showing the same in a separated inoperative condition for clarity of disclosure.

As illustrated in FIG. 2, the exercise device 20 includes a pair of opposed stops 21, 22 and nonelastic but flexible strap means 24 adapted to be interconnected therebetween. Each stop 21, 22 is in the form of a tapered wedge having a generally flat base surface 26 adapted to butt against the floor and having an upwardly tapering wedge surface 28 designed to engage the bottom 30 of the door 10. The two surfaces 26, 28 are angled generally from apex 32 where the strap means 24 angles from connection relative to the stop.

The rear stop surface 34 is angled relative to both the base and wedge surfaces 26, 28.

The strap means 24 itself is formed of two separate pieces 41, 42 of a nonelastic flexible strong material, such as leather, woven nylon or canvas, or the like, each respectively secured at one of its ends to the stops 21, 22. The strap means 24 further has means for separably connecting the two pieces 41, 42 together in a manner to also allow for the adjustment of the overall strap length.

One form of adjustment-connection 45 (in FIG. 2, for example) would have an eyelet 46 secured to one end of one strap piece 41 and the opposite strap piece 42 would fit through the eyelet and be doubled back onto itself: and hook-loop fastener means 47, 48, such as marked under the Velcro trademark, are formed on strap piece 42 at the end (47) and on the medial part thereof (48) to allow them to be lapped and secured against one another. This would allow for a strong connection between the strap pieces 41, 42 rapidly and easily and further would allow for a wide range of strap length adjustment for tightening down over the exerciser's foot or ankles, when initially preparing to do a set of exercises. By having the strap piece end (47) exposed on the top side of the strap (48) and adjacent the favored hand (right or left) of the exerciser using the device, the exerciser can readily pull up on it to separate the strap pieces and release the user from the device.

Another form of adjustment connection 45A would have a quick release catch buckle 52 secured to one strap piece 41A and would have a catch tab 54 secured to the other strap piece 42A. The catch tab 54 has spring fingers 56 that fit into receiving openings in the buckle piece 52 and interfitting shoulders on the tap and buckle pieces keep them interlocked. The sides 58 of the buckle are cut away below the stops to allow the exposed spring fingers 56 therein to be squeezed together sufficiently to disengage the shoulders and release the tab piece 54 from the buckle piece 52. The weave of the strap piece 42A through the tab piece 54, is initially under two adjacent parallel cross members (only 59 being shown as the other member is hidden under the strap), is around the remote side of the hidden cross member and through the space between the cross members, and is then back-folded to lie adjacent the medial portion of the strap and pass under the cross member 59. The high friction between the strap pieces and the cross members allows the strap piece to be drawn tightly to any of varying strap lengths and be held secured at that position. The advantages of this type adjustment connection 45A is the quick connection and release, the wide range of adjustments of tension or strap size, and its expected durability.

Many other forms of adjustment connection between the two strap pieces would be possible although the same are not disclosed herein.

To use either of the devices 20 or 20A disclosed, the two wedges or stop means 21, 22 are placed on the far side of the door 10 opposite from where the user will be located and the adjacent middle portions of the strap pieces are slipped under the door. The wedge stops 21, 22 can be located as far apart as required for the user, typically of the order of perhaps several inches to perhaps 15 to 20 inches apart, depending upon the extent of leg spread that the user wants in the exercise. The free ends of the strap pieces are located on the same side of the door as the exerciser, and the strap end pieces can be looped over the feet or ankle areas of the user, and can be overlapped with one another and snugged tightly to hold the feet snugged firmly against or relative to the floor and against the door.

In doing situps, the user's heel would be supported on the floor (see FIG. 3) and the sole of the foot would be upstanding and propped against the vertical face of the door 10, and the strap would be laid over the arch area of the foot. With the wedge stops 21, 22 confined under the door 10, the door is fixedly held in a stationary position. Moreover, the person's feet are snugged against the floor even in the event of a forced attempted liftoff from the floor, so as to aid in the performance of situps.

It is possible also with this device, because of the flexible and adjustable nature of the interconnecting strap loop, to allow the user to do back arches or side lifts while securing the feet relative to the floor. To do the back arches, the user (not shown) would be on the stomach (abdominal) area and the feet would be positioned against the door with the toes against the floor and the door and with the heels elevated slightly above the floor. The straps would then be laid over the heel area of the user to hold the foot in place and allow the user to arch the back and lift the stomach and head off the floor. To do side lifts, the same procedure would be followed but the exerciser will be more on his side, and noon the back or stomach.

The strap is perhaps one to three inches wide to provide sufficient engaging area and reasonable comfort in positioning over the foot or ankle area of the user. The strap is perhaps 1/16 to ¼ of an inch thick, providing some body or feel of quality to the unit. The strap length between the wedge stops would preferably be between 20 and 40 inches.

The stops 21, 22 themselves can be formed of a resilient material such as rubber or polymer plastic, or of a hard material such as wood. As illustrated in FIG. 2, the stops 21, 22 can be formed of two halves clamped over the end of the strap and held together by screws. If a hard material is used, it is preferred to coat the material with a softer material, such as rubber or a polymer plastic. Thus, the base surface would have a high coefficient of friction against the floor or supporting surface and will not easily slide relative thereto, and the door can be wedged against the wedge surface without damage the door.

The angle of the wedge stop between the surfaces 26, 28 preferably is in excess of 25°–30° but less than 45°–50°. This allows for the door to be pushed against the inclined wedge surface 28 to form a sound mechanical cooperative fit therewith while not riding up the wedge and become locked thereon, while urging the base surface 26 against the floor 14 so as to hold the wedge stop relative to the floor. Further, the end surface 34 is between possibly 1½ and 2½ inches high to accommodate a wide range of possible variations in clearance space between the floor and the bottom 30 of the door, for the more universal application of this device for varying door conditions.

It would also be preferred to coat the last several inches at the ends of the strap pieces next to the wedge stops 21, 22 with the rubber or polymer plastic (such as up to line 60 in FIG. 2), as they would be slid under the door 10, and the coating would minimize snagging of the strap on the door even if the door were not totally smooth.

In summary, the device allows for placement relative to virtually any type of swinging door having varying clearances from the floor and further with floors having varying types of covering viz., carpet, tile, bare wood or even concrete. The length of the exposed strap loop can be varied to tightly overlie the user's feet and/or ankle; while the disconnect feature of the strap pieces allows the easy set up and release of the strap both before and after doing a set of exercises. Moreover, the device is portable, lightweight and easily transported from place to place for improved versatility and usage.

What is claimed is:

1. A portable exercise device, adapted to be used by an exerciser lying on a floor on one side of a swinging door, for holding his/her feet firmly against the floor and door while doing situps and related exercises, comprising the combination of a pair of stops and flexible nonextendable strap means secured to the stops and extended therebetween, both stops being adapted to be disposed on the opposite side of the door from the exerciser and the strap means adjacent the stops being adapted to be extended initially under the bottom edge of the door and then to define an intermediate loop on the same one side of the door as the exerciser, each of said stops being in the form of a wedge having a generally flat base surface adapted to be disposed against the floor and an upwardly inclined generally flat wedge surface adapted to be positioned against the bottom edge of the door, the strap means being secured relative to the stops and extended from an apex between the wedge and base surfaces in a direction away from the stops, and under the door, each stop means itself being formed of two pieces each having a complementary surface angled away from the apex, the pieces being arranged with the complementary surfaces adjacent one another and with the strap means between the surfaces, means securing the pieces together with the strap means trapped between the complementary surfaces of the pieces, separable means formed in the intermediate loop part of the strap means located on the one side of the door, allowing for the complete separation of the strap means into two separate end pieces each secured to one of the stops, whereby the strap end pieces may be laid over the foot or ankle areas of the excerciser and be secured together to define the loop, and the adjustment of the length of the strap means for drawing the strap means tightly against the foot or ankle area of the exerciser.

2. A portable exercise device, adapted to be used by an exerciser lying on a floor on one side of a swinging door, for holding his/her feet firmly against the floor and door while doing situps and related exercises, comprising the combination of a pair of stops and flexible nonextendable strap means secured to the stops and extended therebetween, both stops being adapted to be disposed on the opposite side of the door from the exerciser and the strap means adjacent the stops being adapted to be extended initially under the bottom edge of the door and then to define an intermediate loop on the same one side of the door as the exerciser, each of said stops being in the form of a wedge having a generally flat base surface adapted to be disposed against the floor and an upwardly inclined generally flat wedge surface to be positioned against the bottom edge of the door, the strap means being secured relative to the stops and extended from an apex between the wedge and base surfaces in a direction away from the stops, and under the door, each stop means itself being formed of two pieces each having a wedge shape with a pair of generally flat surfaces angled relative to one another from along a generally common edge, the pieces being arranged with the common edges adjacent one another at the apex of the stop means and with the strap means between adjacent surfaces of the wedge pieces, screw means securing the wedge piece together with the strap means trapped between the adjacent surfaces of the pieces, and separable means formed in the intermediate loop part of the strap means located on the one side of the door, allowing for the complete separation of the strap means into two separate end pieces each secured to one of the stops, whereby the strap end pieces may be laid over the foot or ankle areas of the exerciser and be secured together to define the loop, and the adjustment of the length of the strap means for drawing the strap means tightly against the foot or ankle area of the exerciser.

3. A portable exercise device for doing situps and related exercises according to claim 2, further wherein a polymer plastic covers the exterior of each of the stop means, said material being softer than the material of the stop means and providing a high coefficient of friction against the floor and door, without damaging either.

4. A portable exercise device for doing situps and related exercises according to claim 3, further wherein a polymer plastic is coated over the exterior of the strap means in the regions only adjacent each of the stop means, said material minimizing snagging of the strap means on the door.

5. A portable exercise device for doing situps and related exercises according to claim 2, wherein the base and wedge surfaces are separated from one another between 1.5 and 2.5 inches at the high end remote from the apex.

6. A portable exercise device for doing situps and related exercises according to claim 2, wherein the base and wedge surfaces are angled relative to one another between 25 and 50 degrees.

7. A portable exercise device for doing situps and related exercises according to claim 6, wherein the base and wedge surfaces are separated from one another between 1.5 and 2.5 inches at the high end remote from the apex.

8. A portable exercise device for doing situps and related exercises according to claim 7, further wherein a polymer plastic covers the exterior of each of the stop means, said material being softer than the material of the stop means and providing a high coefficient of friction against the floor and door, without damaging either, and a polymer plastic is coated over the exterior of the strap means in the regions only adjacent each of the stop means that are adapted to fit under the door, said material minimizing snagging of the strap means on the door.

* * * * *